US012729889B2

(12) United States Patent
Park et al.

(10) Patent No.: US 12,729,889 B2
(45) Date of Patent: Sep. 8, 2026

(54) HEAT PUMP

(71) Applicant: LG ELECTRONICS INC., Seoul (KR)

(72) Inventors: Sangil Park, Seoul (KR); Jeongseob Shin, Seoul (KR); Seungtaek Oh, Seoul (KR); Soojin Kang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 51 days.

(21) Appl. No.: 18/721,610

(22) PCT Filed: Nov. 2, 2022

(86) PCT No.: PCT/KR2022/016993
§ 371 (c)(1),
(2) Date: Jun. 18, 2024

(87) PCT Pub. No.: WO2023/120960
PCT Pub. Date: Jun. 29, 2023

(65) Prior Publication Data

US 2024/0353157 A1 Oct. 24, 2024

(30) Foreign Application Priority Data

Dec. 20, 2021 (KR) ..... 10-2021-0182898

(51) Int. Cl.
*F25B 30/02* (2006.01)
*F25B 41/20* (2021.01)

(52) U.S. Cl.
CPC ..... *F25B 30/02* (2013.01); *F25B 41/20* (2021.01); *F25B 2400/051* (2013.01);
(Continued)

(58) Field of Classification Search
CPC .. F24D 3/18; F24D 17/02; F25B 30/02; F25B 41/20; F25B 41/30; F25B 41/34;
(Continued)

(56) References Cited

U.S. PATENT DOCUMENTS

2012/0111032 A1* 5/2012 Woo ..... F24H 4/02 62/132
2020/0284497 A1* 9/2020 Blatchley ..... B60H 1/00899
(Continued)

FOREIGN PATENT DOCUMENTS

CN 214469331 U 10/2021
EP 2339267 A2 * 6/2011 ..... F25B 27/02
(Continued)

OTHER PUBLICATIONS

Pdf is translation of foreign reference EP-2339267-A2 (Year: 2011).*

*Primary Examiner* — Len Tran
*Assistant Examiner* — Kamran Tavakoldavani
(74) *Attorney, Agent, or Firm* — Birch, Stewart, Kolasch & Birch, LLP

(57) ABSTRACT

A heat pump may include: a compressor compressing refrigerant received from an accumulator; a water-refrigerant heat exchanger exchanging heat between the refrigerant discharged from the compressor and water; a main expansion valve expanding the refrigerant passed through the water-refrigerant heat exchanger; an outdoor heat exchanger exchanging heat between the refrigerant passed through the main expansion valve and outdoor air and connected to the accumulator; a main pipe connecting the water-refrigerant heat exchanger and the outdoor heat exchanger, the main pipe at which the main expansion valve is installed; an internal heat exchanger installed at the main pipe between the water-refrigerant heat exchanger and the main expansion valve; an injection pipe at which the internal heat exchanger is installed; an injection valve installed at the injection pipe;
(Continued)

a bypass pipe; and a bypass valve installed at the bypass pipe.

14 Claims, 8 Drawing Sheets

(52) U.S. Cl.
CPC ..... *F25B 2600/2501* (2013.01); *F25B 2600/2513* (2013.01); *F25B 2700/21152* (2013.01)

(58) Field of Classification Search
CPC ..... F25B 13/00; F25B 31/008; F25B 49/02; F25B 2339/047; F25B 2400/0411; F25B 2400/0417; F25B 2400/051; F25B 2400/054; F25B 2400/13; F25B 2600/2501; F25B 2600/2509; F25B 2600/2513; F25B 2700/21; F25B 2700/21152; F25B 2700/21161; F24H 15/30; F24H 15/219; F24H 15/223; F24H 15/385; F24H 15/258
See application file for complete search history.

(56) References Cited

U.S. PATENT DOCUMENTS

| | | | | |
|---|---|---|---|---|
| 2022/0305883 | A1* | 9/2022 | Ishizeki ..... | B60H 1/22 |
| 2023/0221050 | A1* | 7/2023 | Matsushita ..... | F25B 25/005 62/125 |

FOREIGN PATENT DOCUMENTS

| | | | |
|---|---|---|---|
| EP | 2 607 809 | A2 | 6/2013 |
| JP | 2007-132622 | A | 5/2007 |
| JP | 2011-179777 | A | 9/2011 |
| KR | 10-2011-0062457 | A | 6/2011 |
| KR | 10-1303483 | B1 | 9/2013 |
| KR | 10-1636326 | B1 | 7/2016 |
| KR | 10-2020-0067425 | A | 6/2020 |
| KR | 10-2021-0073990 | A | 6/2021 |
| WO | WO 2019/053880 | A1 | 3/2019 |

* cited by examiner

[FIG. 1]
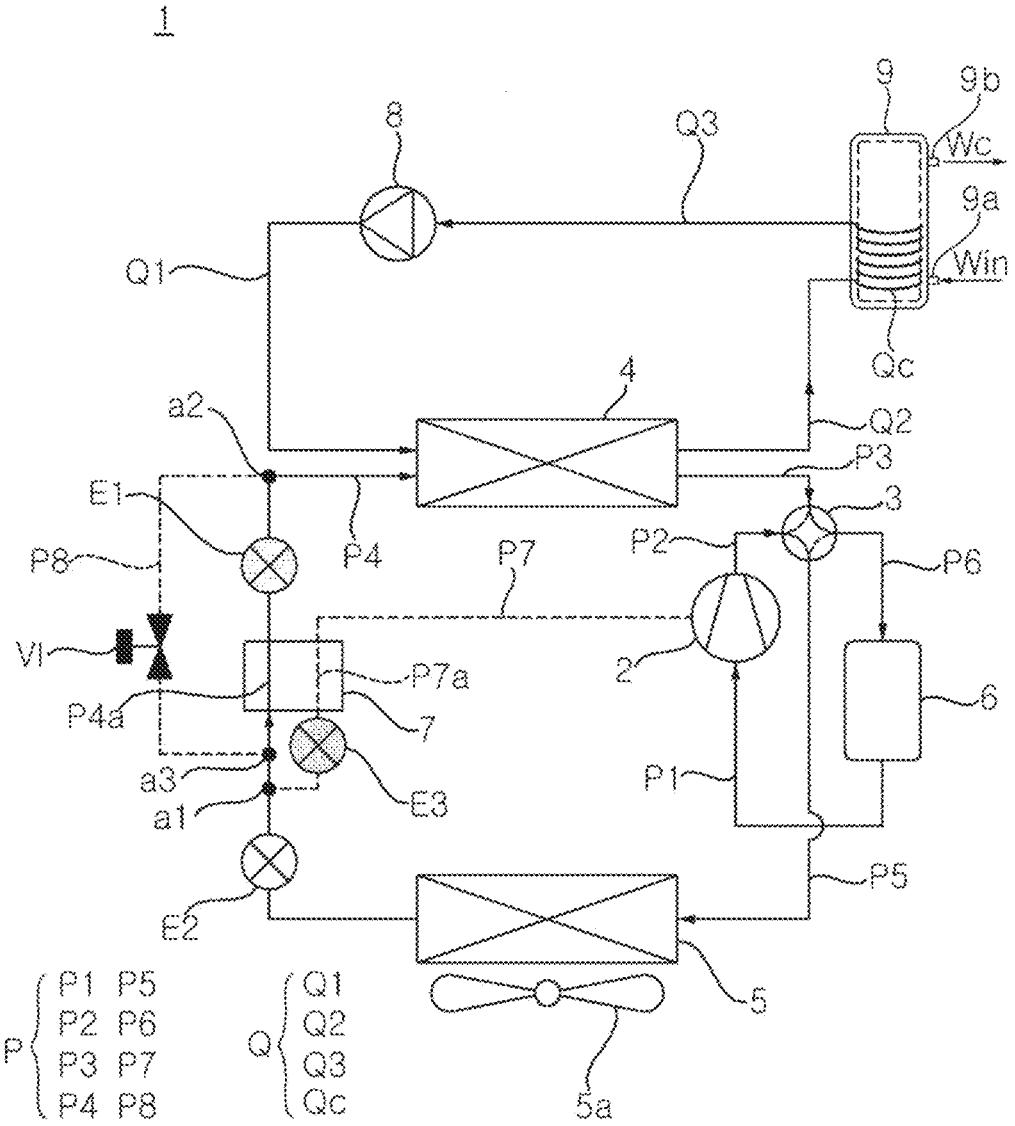

[FIG. 2]
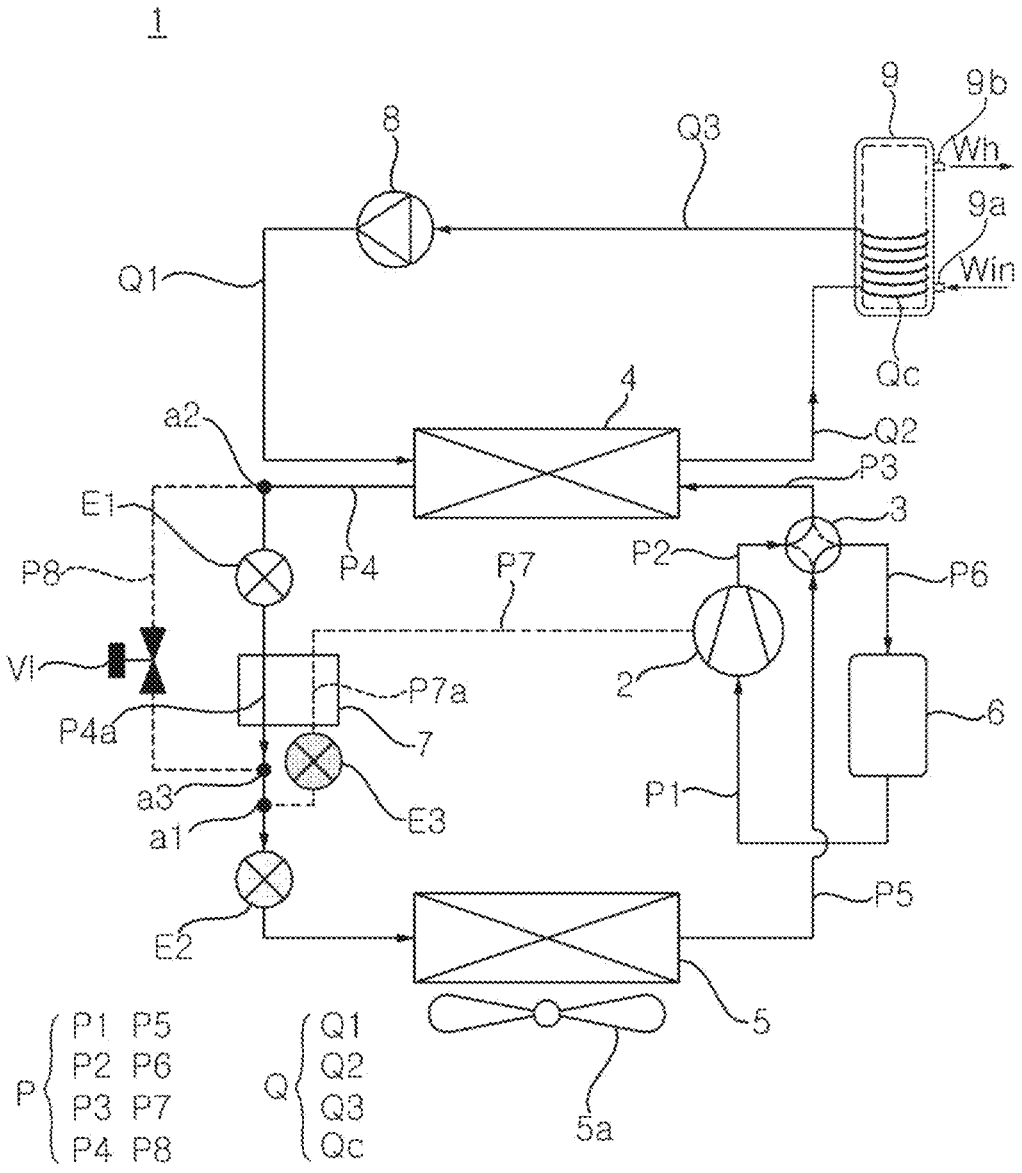

[FIG. 3]
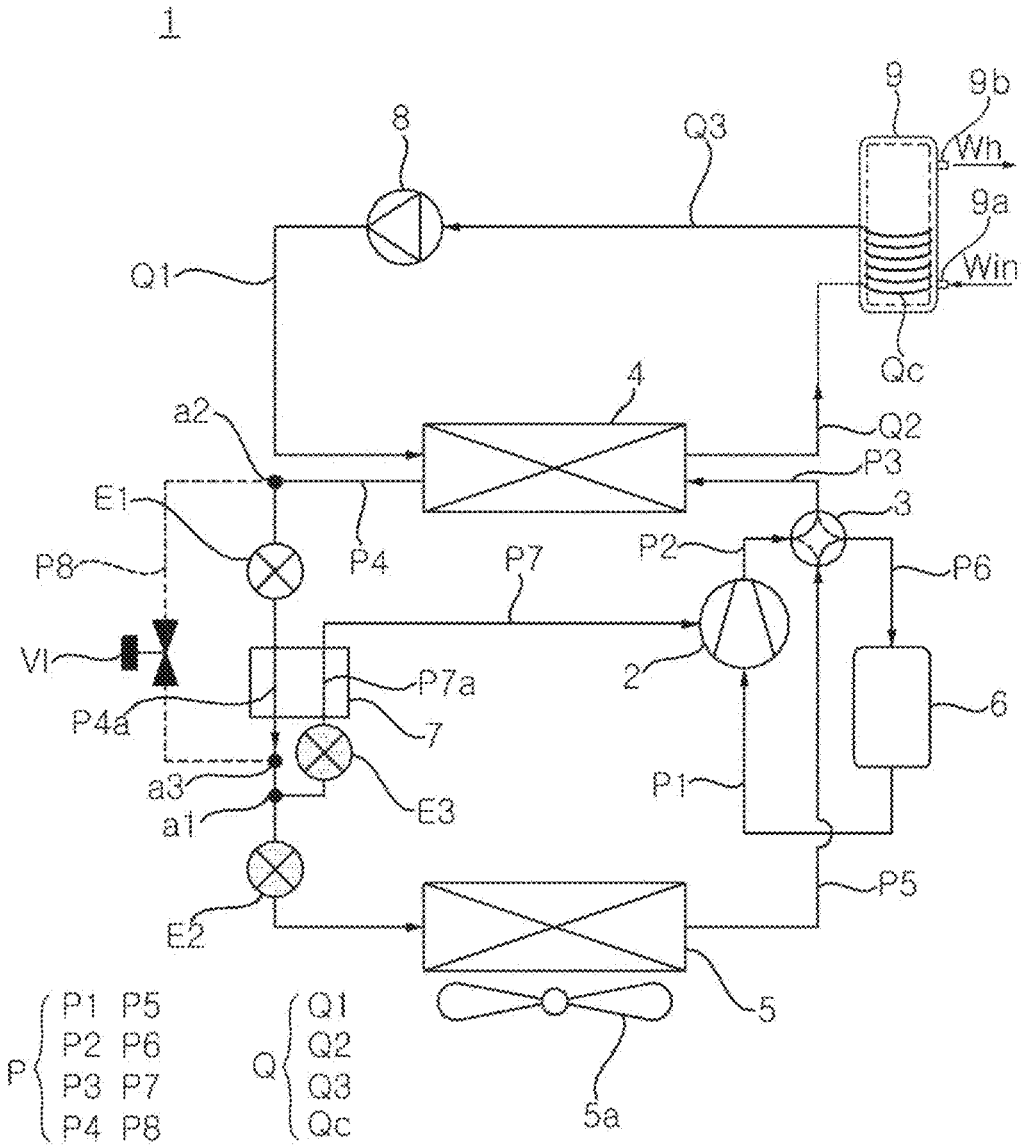

[FIG. 4]
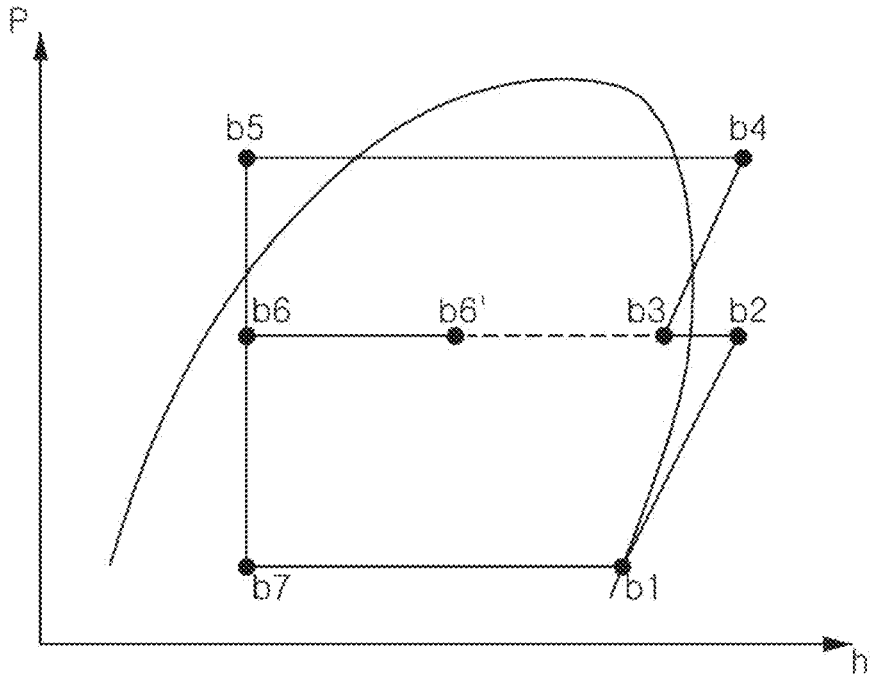

[FIG. 5]
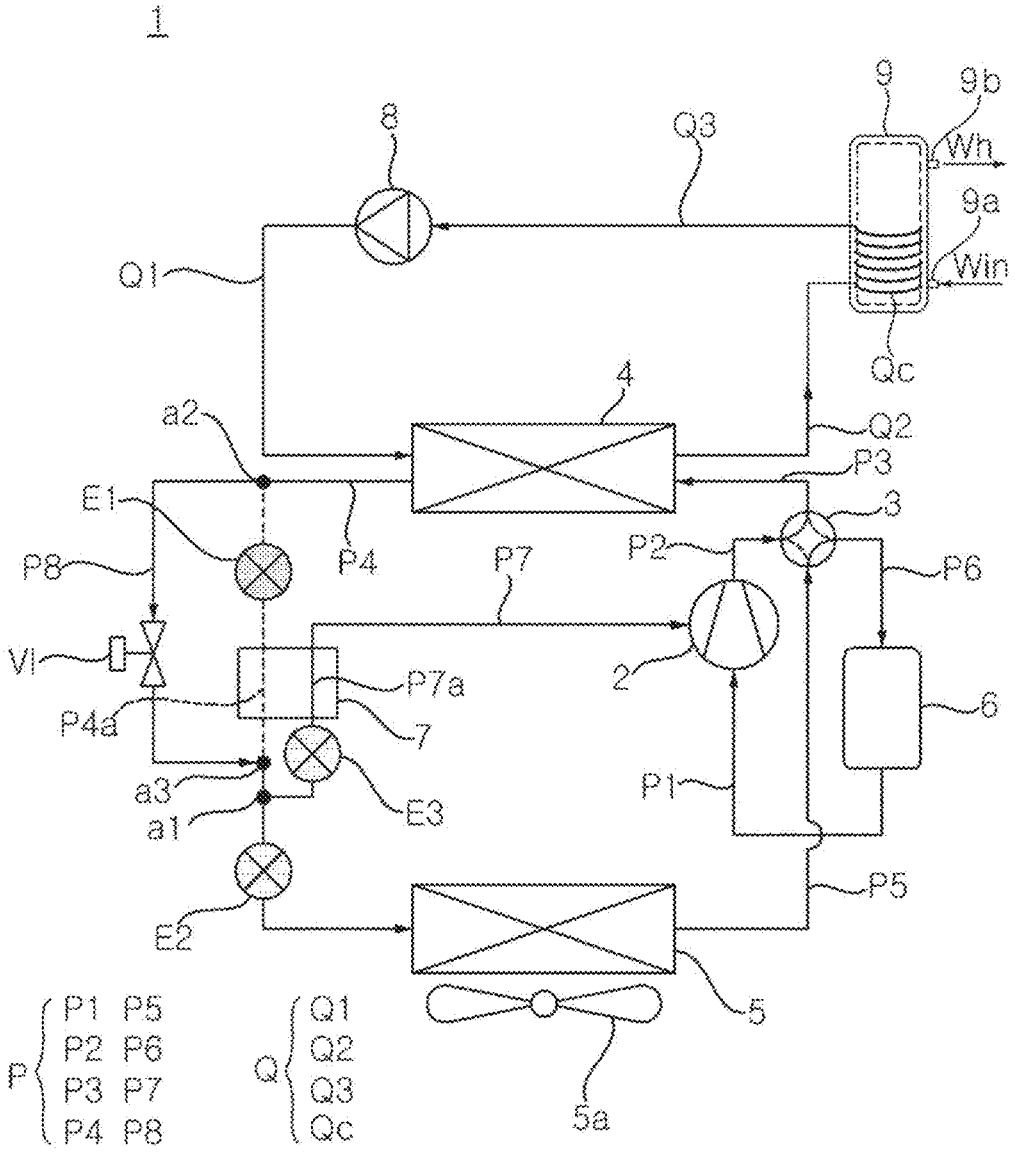

[FIG. 6]
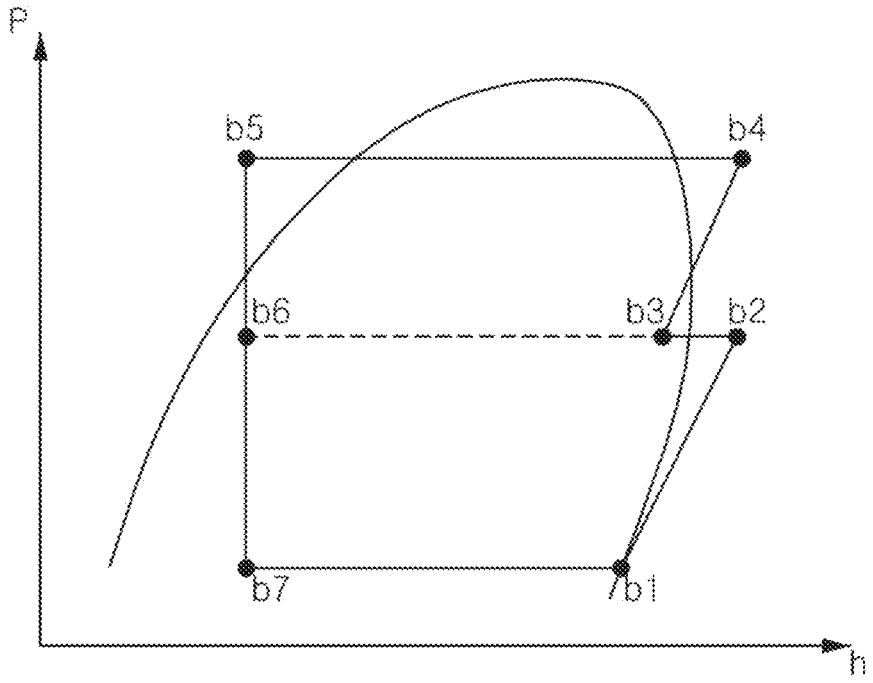

[FIG. 7]
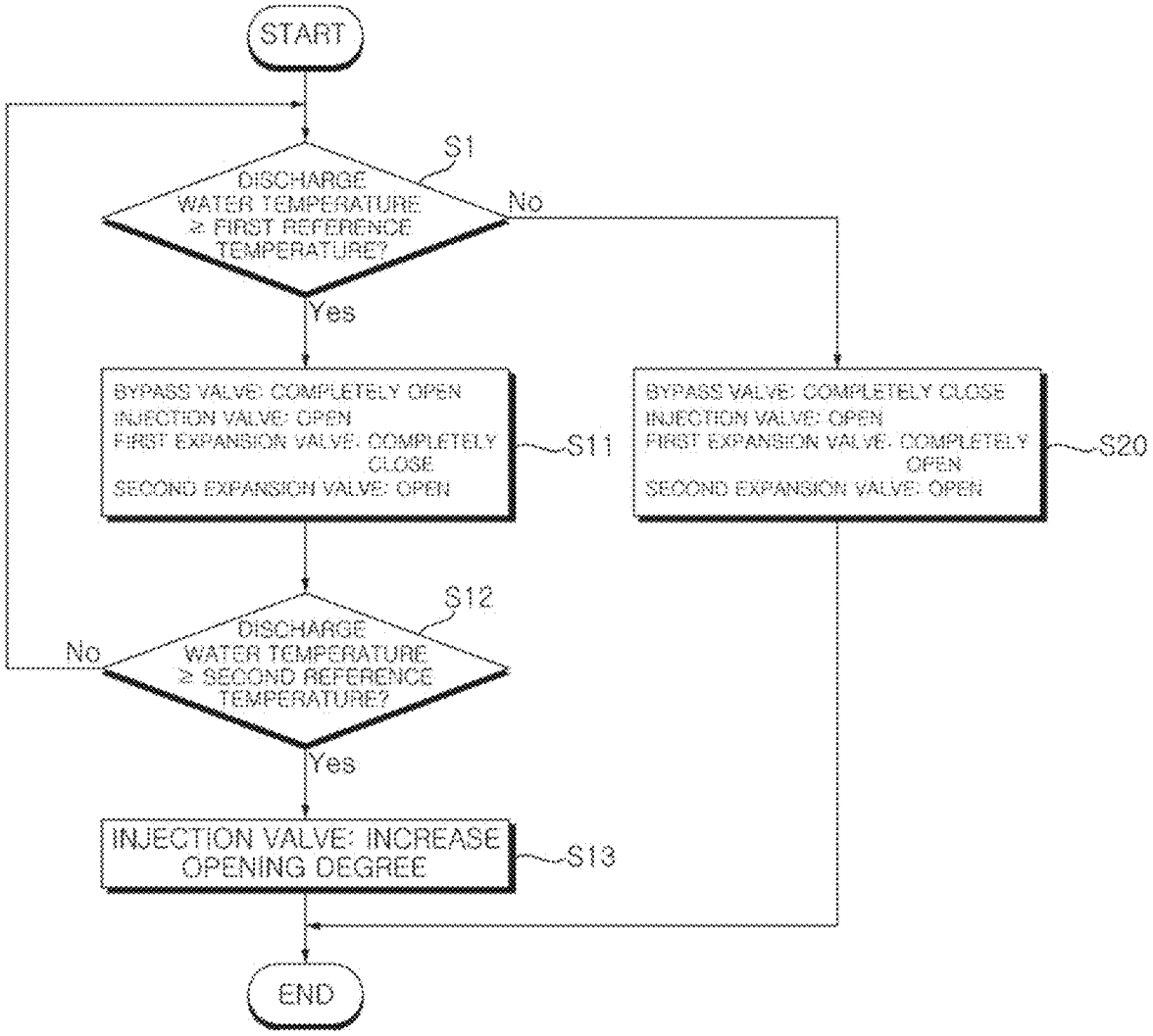

[FIG. 8]
(a)
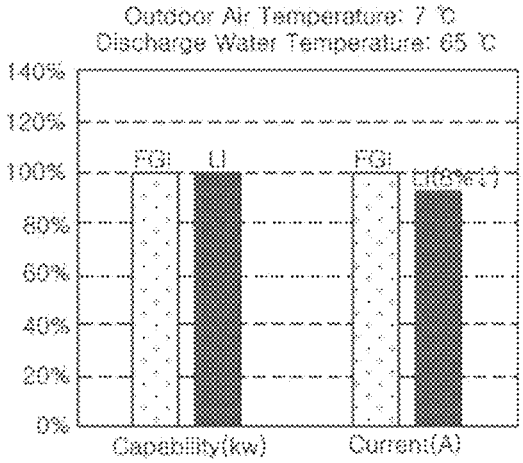
(b)
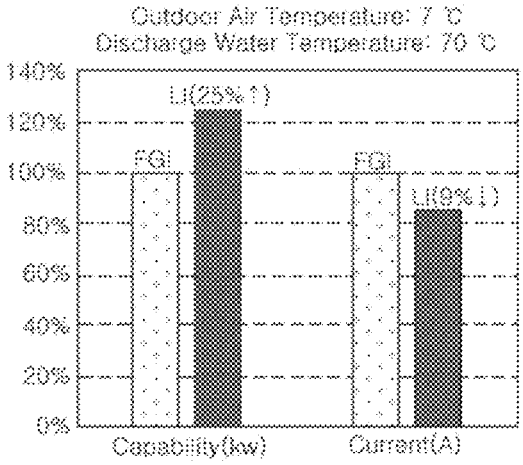
(c)
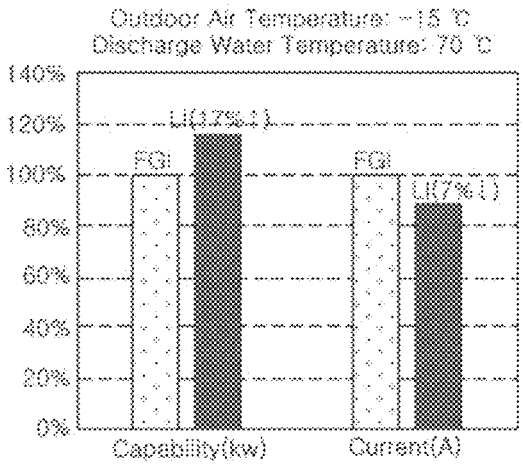

HEAT PUMP

CROSS REFERENCE TO RELATED APPLICATIONS

This application is the National Phase of PCT International Application No. PCT/KR2022/016993, filed on Nov. 2, 2022, which claims priority under 35 U.S.C. 119 (a) to Patent Application No. 10-2021-0182898, filed in the Republic of Korea on Dec. 20, 2021, all of which are hereby expressly incorporated by reference into the present application.

TECHNICAL FIELD

The present disclosure relates to a heat pump.

BACKGROUND ART

In general, a heat pump represents an apparatus configured to heat/cool an indoor space through compression, condensation, expansion, and evaporation procedures of refrigerant. When an outdoor heat exchanger of a heat pump functions as a condenser, and an indoor heat exchanger of the heat pump functions as an evaporator, an indoor space may be cooled. On the other hand, when the indoor heat exchanger of the heat pump functions as a condenser, and the outdoor heat exchanger of the heat pump functions as an evaporator, the indoor space may be heated.

For example, the indoor heat exchanger of the heat pump may be a water-refrigerant heat exchanger using water as a medium for exchanging heat with refrigerant. The water heated through heat exchange with the refrigerant may increase a temperature of water stored in a water tank and, as such, hot water may be supplied to the indoor space. Otherwise, the water heated through heat exchange with the refrigerant may heat the indoor space while flowing through a water pipe installed in the indoor space.

However, when hot water or the like is supplied to the indoor space using the heat pump under the condition that an outdoor air temperature is 0° C. or less, a compressor may operate at a high compression ratio and, as such, the temperature of refrigerant discharged from the compressor may be excessively increased. For this reason, internal parts of the compressor may be damaged, and a circulation amount of the refrigerant may be reduced. As a result, performance of the heat pump may be degraded.

To this end, conventional heat pumps have proposed a scheme for injecting refrigerant into a compressor. In detail, a part of refrigerant emerging from a condenser expands, and is injected into the compressor while exchanging heat with the remaining part of the refrigerant emerging from the condenser. However, when the amount of the refrigerant injected into the compressor is increased in order to decrease the temperature of the refrigerant discharged from the compressor, the load of a motor of the compressor is increased, and the amount of current flowing through a PCB of the compressor may reach a limit thereof. In other words, the conventional scheme has a problem in that it is difficult to secure heat pump performance of a desired level or more.

DETAILED DESCRIPTION OF INVENTION

Technical Problems

It is an objective of the present disclosure to solve the above problems and other problems.

Another object may be to provide a heat pump capable of preventing the pressure and temperature of refrigerant discharged from a compressor thereof from being excessively increased.

Another object may be to provide a heat pump capable of enhancing heating performance thereof by reducing the load and current value of a motor of a compressor thereof.

Another object may be to provide a heat pump capable of adjusting a state (that is, enthalpy) of refrigerant injected into a compressor thereof in accordance with a discharge water temperature of a water-refrigerant heat exchanger thereof.

Technical Solution

In accordance with one aspect of the present disclosure to achieve the above or other objectives, a heat pump may include: a compressor compressing refrigerant received from an accumulator; a water-refrigerant heat exchanger exchanging heat between the refrigerant discharged from the compressor and water; a main expansion valve expanding the refrigerant passed through the water-refrigerant heat exchanger; an outdoor heat exchanger exchanging heat between the refrigerant passed through the main expansion valve and outdoor air and connected to the accumulator; a main pipe connecting the water-refrigerant heat exchanger and the outdoor heat exchanger, the main pipe at which the main expansion valve is installed; an internal heat exchanger installed at the main pipe between the water-refrigerant heat exchanger and the main expansion valve; an injection pipe which has one end connected to a first point of the main pipe between the internal heat exchanger and the main expansion valve, which has the other end connected to the compressor, and at which the internal heat exchanger is installed; an injection valve installed at the injection pipe between the first point and the internal heat exchanger; a bypass pipe which has one end connected to a second point of the main pipe between the water-refrigerant heat exchanger and the internal heat exchanger, which has the other end connected to a third point of the main pipe between the internal heat exchanger and the first point; and a bypass valve installed at the bypass pipe.

Effect of Invention

A heat pump according to the present disclosure has the following effects.

According to at least one of the embodiments of the present disclosure, it is possible to provide a heat pump capable of preventing the pressure and temperature of refrigerant discharged from a compressor thereof from being excessively increased.

According to at least one of the embodiments of the present disclosure, it is possible to provide a heat pump capable of enhancing heating performance thereof by reducing the load and current value of a motor of a compressor thereof.

According to at least one of the embodiments of the present disclosure, it is possible to provide a heat pump capable of adjusting a state (that is, enthalpy) of refrigerant injected into a compressor thereof in accordance with a discharge water temperature of a water-refrigerant heat exchanger thereof.

An additional range of applicability of the present disclosure may be apparent from the following detailed description. However, various changes and modifications in the spirit and scope of the present disclosure may be clearly understood by a skilled person in the field to which the present disclosure pertains. Therefore, it should be understood that the detailed description and particular embodiments such as preferred embodiments of the present disclosure are given only for illustrative purposes.

BRIEF DESCRIPTION OF THE DRAWING

FIG. 1 is a diagram explaining a cold water supply operation of a heat pump according to an embodiment of the present disclosure.

FIG. 2 is a diagram explaining a hot water supply operation of the heat pump according to the embodiment of the present disclosure.

FIGS. 3 and 4 are diagrams explaining a first injection operation in a hot water supply operation mode of the heat pump according to the embodiment of the present disclosure.

FIGS. 5 and 6 are diagrams explaining a second injection operation in the hot water supply operation mode of the heat pump according to the embodiment of the present disclosure.

FIG. 7 is a flowchart explaining a control method associated with the first injection operation and the second injection operation of the heat pump according to the embodiment of the present disclosure.

FIG. 8 is a graph for comparison between the first injection operation and the second injection operation according to the embodiment of the present disclosure.

MODE FOR CARRYING OUT THE INVENTION

Hereinafter, embodiments of the present disclosure will be described in detail with reference to the accompanying drawings, and the same or similar elements are designated by the same reference numerals regardless of the numerals in the drawings and redundant description thereof will be omitted.

The suffixes "module" and "unit" of elements herein are used for convenience of description and thus can be used interchangeably and do not have any distinguishable meanings or functions.

In the following description of the embodiments of the present disclosure, a detailed description of known functions and configurations incorporated herein will be omitted when it may obscure the subject matter of the embodiments of the present disclosure. In addition, the embodiments of the present disclosure will be more clearly understood from the accompanying drawings and should not be limited by the accompanying drawings, and it is to be appreciated that all changes, equivalents, and substitutes that do not depart from the spirit and technical scope of the present disclosure are encompassed in the present disclosure.

It will be understood that, although the terms "first," "second," etc. may be used herein to describe various elements, these elements should not be limited by these terms. These terms are only used to distinguish one element from another.

In the case where an element is "connected" or "linked" to another element, it should be understood that the element may be directly connected or linked to the other element, or another element may be present therebetween. Conversely, in the case where an element is "directly connected" or "directly linked" to another element, it should be understood that no other element is present therebetween.

Unless clearly used otherwise, singular expressions include a plural meaning.

In the following description, although embodiments are described with reference to particular figures, reference numerals not represented in the particular figures may be mentioned. The reference numerals not represented in the particular figures are used in the case in which the reference numerals are represented in other figures.

Referring to FIG. 1, a heat pump 1 may include a compressor 2, a selector valve 3, a water-refrigerant heat exchanger 4, an outdoor heat exchanger 5, an accumulator 6, an internal heat exchanger 7, a pump 8, and a water tank 9. The compressor 2, the selector valve 3, the water-refrigerant heat exchanger 4, the outdoor heat exchanger 5, the accumulator 6, and the internal heat exchanger 7 may be interconnected through a refrigerant pipe P. The internal heat exchanger 7, the pump 8, and the water tank 9 may be interconnected by a water pipe Q.

The compressor 2 may compress refrigerant introduced thereinto from the accumulator 6 and, as such, may discharge high-temperature and high-pressure refrigerant. The accumulator 6 may supply gaseous refrigerant to the compressor 2 through a first refrigerant pipe P1. A second refrigerant pipe P2 may be installed between the compressor 2 and the selector valve 3 to provide a flow path of refrigerant extending from the compressor 2 to the selector valve 3. For example, the compressor 2 may be an inverter compressor capable of adjusting an operation frequency thereof, thereby controlling a refrigerant amount and a discharge pressure of refrigerant.

The selector valve 3 may change a flow path in accordance with an operation mode of the heat pump, and may selectively guide refrigerant introduced through the second refrigerant pipe P2 to the water-refrigerant heat exchanger 4 or the outdoor heat exchanger 5. For example, the directional valve 3 may be a 4-way valve. A sixth refrigerant pipe P6 may be installed between the selector valve 3 and the accumulator 6 to provide a flow path of refrigerant extending from the selector valve 3 to the accumulator 6.

The water-refrigerant heat exchanger 4 may perform heat exchange between refrigerant and water. The direction of heat transfer between refrigerant and water in the water-refrigerant heat exchanger 4 may be changed in accordance with an operation mode of the heat pump. A third refrigerant pipe P3 may be installed between the selector valve 3 and the water-refrigerant heat exchanger 4 to provide a flow path of refrigerant interconnecting the selector valve 3 and the water-refrigerant heat exchanger 4.

For example, the water-refrigerant heat exchanger 4 may be a plate heat exchanger including a plurality of stacked heat transfer plates. In this case, refrigerant and water flow through flow paths formed among the plurality of heat transfer plates and, as such, may exchange heat with each other in a non-contact manner. In another example, the water-refrigerant heat exchanger 4 may be a water tank formed with a port through which water is introduced or discharged. In this case, water may be stored in the water tank, and a pipe, through which refrigerant flows, may be provided in the form of a coil around the water tank. As such, the refrigerant and the water may exchange heat with each other in a non-contact manner.

The pump 8 may be connected to the water-refrigerant heat exchanger 4 through a water pipe. The pump 8 may generate a flow of water flowing along the water pipe. A first water pipe Q1 may be installed between the pump 8 and the water-refrigerant heat exchanger 4 to provide a flow path of water interconnecting the pump 8 and the water-refrigerant heat exchanger 4.

The water tank 9 may receive water from a water supply source (not shown) to store the received water (cf. "Win"), and may supply the water to water use places in an indoor space. The water tank 9 may take a cylindrical shape on the whole, and may include an inlet 9*a* configured to receive water Win supplied from the water supply source, and an outlet 9*b* configured to supply water Wc to the water use places in the indoor space.

A coil Qc may surround at least a portion of an outer peripheral surface of the water tank 9 by plural turns. Water emerging from the water-refrigerant heat exchanger 4 may be introduced into one end of the coil Qc, and the introduced water may be discharged from the other end of the coil Qc and may then be supplied to the pump 8. A second water pipe Q2 may be installed between the water-refrigerant heat exchanger 4 and the one end of the coil Qc to provide a flow path of water interconnecting the water-refrigerant heat exchanger 4 and the coil Qc. A third water pipe Q3 may be installed between the other end of the coil Qc and the pump 8 to provide a flow path of water interconnecting the coil Qc and the pump 8.

Accordingly, heat exchange may be carried out between the water stored in the water tank 9 and the water flowing through the coil Qc in a non-contact manner. Meanwhile, water emerging from the water-refrigerant heat exchanger 4 may be supplied to a radiator (not shown), a water pipe installed at a floor of the indoor space, a fan coil unit (FCU), etc. and, as such, may be used to cool/heat the indoor space. Meanwhile, differently from the above-described case, the pump 8 may be connected to the water supply source (not shown) and, as such, water emerging from the water-refrigerant heat exchanger 4 may be supplied to the indoor space without passing through the coil Qc.

The outdoor heat exchanger 5 may perform heat exchange between refrigerant and a heat transfer medium. The direction of heat transfer between the refrigerant and the heat transfer medium in the outdoor heat exchanger 5 may be changed in accordance with an operation mode of the heat pump.

For example, the heat transfer medium may be outdoor air. An outdoor fan 5*a* may be disposed at one side of the outdoor heat exchanger 5 and may adjust an amount of air supplied to the outdoor heat exchanger 5. A fifth refrigerant pipe P5 may be installed between the selector valve 3 and the outdoor heat exchanger 5 to provide a flow path of refrigerant interconnecting the selector valve 3 and the outdoor heat exchanger 5.

A first expansion valve E1 and a second expansion valve E2 may be installed at a fourth refrigerant pipe P4 to adjust an opening degree of a flow path of the fourth refrigerant pipe P4. In this case, the fourth refrigerant pipe P4 may be installed between the water-refrigerant heat exchanger 4 and the outdoor heat exchanger 5 to provide a flow path of refrigerant interconnecting the water-refrigerant heat exchanger 4 and the outdoor heat exchanger 5. The fourth refrigerant pipe P4 may be referred to as a main pipe P4.

In addition, the first expansion valve E1 may be disposed nearer to the water-refrigerant heat exchanger 4 than to the second heat exchanger 5, whereas the second expansion valve E2 may be disposed nearer to the outdoor heat exchanger 5 than to the water-refrigerant heat exchanger 4. For example, each of the first expansion valve E1 and the second expansion valve E2 may be an electronic expansion valve (EEV). The first expansion valve E1 may be referred to as a sub-expansion valve, and the second expansion valve E2 may be referred to as a main expansion valve.

The internal heat exchanger 7 may be installed at the fourth refrigerant pipe P4 between the first expansion valve E1 and the second expansion valve E2. A first heat exchange pipe P4*a* and a second heat exchange pipe P7*a* may be disposed in an interior of the internal heat exchanger 7. The first heat exchange pipe P4*a* and the second heat exchange pipe P7*a* may face each other while being disposed adjacent to each other.

In this case, the first heat exchange pipe P4*a* may be a part of the above-described fourth refrigerant pipe P4, and the second heat exchange pipe P7*a* may be a part of a seventh refrigerant pipe P7 which will be described later. The seventh refrigerant pipe P7 may be connected, at one end thereof, to a first point a1 of the fourth refrigerant pipe P4 between the internal heat exchanger 7 and the second expansion valve E2. The seventh refrigerant pipe P7 may be connected to the compressor 2 at the other end thereof. The seventh refrigerant pipe P7 may be referred to as an injection pipe.

In addition, an injection valve E3 may be installed at the seventh refrigerant pipe P7 between the first point a1 and the second heat exchange pipe P7*a* to adjust an opening degree of a flow path of the seventh refrigerant pipe P7. For example, the injection valve E3 may be a solenoid valve or an electronic expansion valve (EEV).

Meanwhile, an eighth refrigerant pipe P8 may be connected, at one end thereof, to a second point a2 of the fourth refrigerant pipe P4 between the water-refrigerant heat exchanger 4 and the first expansion valve E1. The eighth refrigerant pipe P8 may be connected, at the other end thereof, to a third point a3 of the fourth refrigerant pipe P4 between the internal heat exchanger 7 and the first point a1. The eighth refrigerant pipe P8 may be referred to as a bypass pipe.

In addition, a bypass valve VI may be installed at the eighth refrigerant pipe P8 to adjust an opening degree of a flow path of the eighth refrigerant pipe P8. For example, the bypass valve VI may be a solenoid valve or an electronic expansion valve (EEV).

A controller (not shown) may be electrically connected to each configuration of the heat pump. The controller may control each configuration of the heat pump in accordance with an operation mode of the heat pump. As described above, the heat pump may supply cold water or hot water to the indoor space in accordance with an operation mode thereof, and the cold water or hot water may be supplied to a kitchen, a restroom, a bathroom, or the like or may be supplied to cool or heat the indoor space.

Referring to FIGS. 1 and 2, the controller may perform a cold water supply operation or a hot water supply operation by controlling operation of the heat pump.

Cold Water Supply Operation Mode of Heat Pump

Referring to FIG. 1, when a cold water supply operation signal is received by the heat pump 1, the controller may perform a cold water supply operation of the heat pump 1.

For example, the cold water supply operation signal may be a signal optionally input by the user. In another example, the cold water supply operation signal may be a signal supplied from a temperature sensor provided at the water tank 9 to the controller when the temperature of water stored in the water tank 9 sensed by the temperature sensor is higher than a target temperature.

In detail, refrigerant may be introduced into the compressor 2 from the accumulator 6 through the first refrigerant pipe P1. High-temperature and high-pressure refrigerant discharged from the compressor 2 may be introduced into the outdoor heat exchanger 5 via the second refrigerant pipe P2, the selector valve 3, and the fifth refrigerant pipe P5.

The outdoor heat exchanger 5 may function as a condenser. The refrigerant condensed while passing through the outdoor heat exchanger 5 may pass through the fourth refrigerant pipe P4. In this case, the second expansion valve E2 may be completely opened, and the first expansion valve E1 may be opened at a certain opening degree. In addition, the bypass valve VI and the injection valve E3 may be completely closed. Refrigerant expanding while passing through the first expansion valve E1 may be introduced into the water-refrigerant heat exchanger 4. Water may be introduced into the water-refrigerant heat exchanger 4 through the first water pipe Q1.

The water-refrigerant heat exchanger 4 may function as an evaporator. In this case, the water may be decreased in temperature while passing through the water-refrigerant heat exchanger 4. The water cooled while passing through the water-refrigerant heat exchanger 4 may pass through the coil Qc via the second water pipe Q2 and, as such, may cool water stored in the water tank 9. Accordingly, water Win introduced into the water tank 9 through the inlet 9*a* may be supplied to each use place in the indoor space through the outlet 9*b* as cold water Wc. For example, the use place may be a water pipe installed at the floor of the indoor space and, in this case, the cold water Wc may cool the indoor space. The water increased in temperature while passing through the coil Qc may return to the pump 8 through the third water pipe Q3.

In addition, the refrigerant evaporating while passing through the water-refrigerant heat exchanger 4 may be introduced into the compressor 2 while sequentially passing through the third refrigerant pipe P3, the selector valve 3, the sixth refrigerant pipe P6, the accumulator 6, and the first refrigerant pipe P1. Thus, a cycle for the above-described cold water supply operation of the heat pump may be completed.

Hot Water Supply Operation Mode of Heat Pump

Referring to FIG. 2, when a hot water supply operation signal is received by the heat pump 1, the controller may perform a hot water supply operation of the heat pump 1. For example, the hot water supply operation signal may be a signal optionally input by the user. In another example, the hot water supply operation signal may be a signal supplied from the temperature sensor provided at the water tank 9 to the controller when the temperature of water stored in the water tank 9 sensed by the temperature sensor is lower than a target temperature.

In detail, refrigerant may be introduced into the compressor 2 from the accumulator 6 through the first refrigerant pipe P1. High-temperature and high-pressure refrigerant discharged from the compressor 2 may be introduced into the water-refrigerant heat exchanger 4 via the second refrigerant pipe P2, the selector valve 3, and the third refrigerant pipe P3.

The water-refrigerant heat exchanger 4 may function as a condenser. In this case, water may be increased in temperature while passing through the water-refrigerant heat exchanger 4. The water heated while passing through the water-refrigerant heat exchanger 4 may pass through the coil Qc via the second water pipe Q2 and, as such, may heat water stored in the water tank 9. Accordingly, water Win introduced into the water tank 9 through the inlet 9*a* may be supplied to each use place in the indoor space through the outlet 9*b* as hot water Wh. For example, the use place may be the water pipe installed at the floor of the indoor space and, in this case, the hot water Wh may heat the indoor space. The water decreased in temperature while passing through the coil Qc may return to the pump 8 through the third water pipe Q3.

In addition, the refrigerant condensed while passing through the water-refrigerant heat exchanger 4 may pass through the fourth refrigerant pipe P4. In this case, the first expansion valve E1 may be completely opened, and the second expansion valve E2 may be opened at a certain opening degree. In addition, the bypass valve VI and the injection valve E3 may be completely closed. Refrigerant expanding while passing through the second expansion valve E2 may be introduced into the outdoor heat exchanger 5.

The outdoor heat exchanger 5 may function as an evaporator. The refrigerant evaporating while passing through the outdoor heat exchanger 5 may be introduced into the compressor 2 while sequentially passing through the fifth refrigerant pipe P5, the selector valve 3, the sixth refrigerant pipe P6, the accumulator 6, and the first refrigerant pipe P1. Thus, a cycle for the above-described hot water supply operation of the heat pump may be completed.

Referring to FIGS. 3 and 4, the controller may perform a first injection operation in the above-described hot water supply operation mode of the heat pump when a certain condition is satisfied. For example, the certain condition may be satisfied when an outdoor temperature is lower than a certain temperature or when the target temperature of water emerging from the water-refrigerant heat exchanger 4 is equal to or above a certain temperature.

When the condition for the first injection operation is satisfied, the controller may adjust a flow path of the selector valve 3 such that the refrigerant discharged from the compressor 2 is guided to the water-refrigerant heat exchanger 4. In addition, the controller may completely open the first expansion valve E1, and may open the second expansion valve E2 at a certain opening degree. Furthermore, the controller may completely close the bypass valve VI, and may open the injection valve E3 at a certain opening degree.

That is, the flow path of the eighth refrigerant pipe P8 may be closed, and the flow path of the seventh refrigerant pipe P7 may be opened. In addition, heat exchange may be carried out between the first heat exchange pipe P4*a* and the second heat exchange pipe P7*a* in the interior of the internal heat exchanger 7.

In this case, an injection refrigerant, which is a part of refrigerant flowing through the flow path of the fourth refrigerant pipe P4, may be bypassed to the seventh refrigerant pipe P7 at the first point a1. The injection refrigerant may expand while passing through the injection valve E3, and may then pass through the internal heat exchanger 7 via the second heat exchange pipe P7*a*.

In addition, the remaining part of the refrigerant flowing through the flow path of the fourth refrigerant pipe P4, except for the injection refrigerant, that is, a main refrigerant, may pass through the internal heat exchanger 7 via the first heat exchange pipe P4*a*. In the internal heat exchanger 7, thermal energy may be transferred from the main refrigerant passing through the first heat exchange pipe P4*a* to the injection refrigerant passing through the second heat exchange pipe P7*a*. That is, the injection refrigerant may be changed in state from b5 to b6 while passing through the injection valve E3, and may be changed in state from b6 to b6' while passing through the second heat exchange pipe P7*a* (cf. FIG. 4). For reference, the refrigerant may be changed in state from b1 to b4 while passing through the compressor 2, and may be changed in state from b4 to b5 while passing through the water-refrigerant heat exchanger 4 (cf. FIG. 4). In addition, the refrigerant may be changed in state from b5 to b7 while passing through the second expansion valve E2, and may be changed in state from b7 to b1 while passing through the outdoor heat exchanger 5 (cf. FIG. 4).

In addition, the injection refrigerant emerging from the internal heat exchanger 7 may be injected into the compressor 2 through the seventh refrigerant pipe P7. In this case, the injection refrigerant may be injected into the compressor 2 at a pressure between the pressure of the refrigerant sucked into the compressor 2 (cf. b1 in FIG. 4) and the pressure of the refrigerant discharged from the compressor 2 (cf. b4 in FIG. 4), that is, an intermediate pressure (cf. b3 in FIG. 4). That is, the injection refrigerant may be injected into an intermediate stage of the compressor 2. For reference, when the injection refrigerant is injected into a suction stage of the compressor, a low pressure of the heat pump may be increased, thereby degrading an evaporator-side heat exchange capability.

The injection refrigerant injected into the compressor 2 may be a two-phase refrigerant and, as such, may be a flash-gas.

Accordingly, the refrigerant injected into the compressor 2 in the first injection operation mode may suppress an excessive increase in pressure and temperature of the refrigerant discharged from the compressor 2.

Meanwhile, the main refrigerant emerging from the internal heat exchanger 7 may be introduced into the compressor 2 while sequentially passing through the second expansion valve E2, the outdoor heat exchanger 5, the selector valve 3, and the accumulator 6.

Referring to FIGS. 5 and 6, the controller may perform a second injection operation in the above-described hot water supply operation mode of the heat pump when a certain condition is satisfied. The certain condition may be satisfied when the target temperature of water emerging from the water-refrigerant heat exchanger 4 is equal to or above a certain temperature.

When the condition for the second injection operation is satisfied, the controller may adjust the flow path of the selector valve 3 such that the refrigerant discharged from the compressor 2 is guided to the water-refrigerant heat exchanger 4. In addition, the controller may completely close the first expansion valve E1, and may open the second expansion valve E2 at a certain opening degree. Furthermore, the controller may completely open the bypass valve VI, and may open the injection valve E3 at a certain opening degree.

That is, the flow path of the eighth refrigerant pipe P8 and the flow path of the seventh refrigerant pipe P7 may be opened, and the first heat exchange pipe P4*a* may be closed. In addition, heat exchange may not be carried out between the first heat exchange pipe P4*a* and the second heat exchange pipe P7*a* in the interior of the internal heat exchanger 7.

In this case, refrigerant flowing through the flow path of the fourth refrigerant pipe P4 may sequentially pass through the second point a2, the eighth refrigerant pipe P8, and the third point a3. An injection refrigerant, which is a part of refrigerant passing through the third point a3, may be bypassed to the seventh refrigerant pipe P7 at the first point a1. The injection refrigerant may expand while passing through the injection valve E3, and may then pass through the internal heat exchanger 7 via the second heat exchange pipe P7*a*.

In addition, no heat exchange may be carried out between the first heat exchange pipe p4*a* and the second heat exchange pipe P7*a* in the interior of the internal heat exchanger 7. That is, the injection refrigerant may be changed in state from b5 to b6 while passing through the injection valve E3, and may be maintained in the state of b6 even though the injection refrigerant passes through the second internal heat exchanger 7 (cf. FIG. 6). For reference, the refrigerant may be changed in state from b1 to b4 while passing through the compressor 2, and may be changed in state from b4 to b5 while passing through the water-refrigerant heat exchanger 4 (cf. FIG. 6). In addition, the refrigerant may be changed in state from b5 to b7 while passing through the second expansion valve E2, and may be changed in state from b7 to b1 while passing through the outdoor heat exchanger 5 (cf. FIG. 6).

In addition, the injection refrigerant emerging from the injection valve E3 may be injected into the compressor 2 through the seventh refrigerant pipe P7. In this case, the injection refrigerant may be injected into the compressor 2 at a pressure between the pressure of the refrigerant sucked into the compressor 2 (cf. b1 in FIG. 6) and the pressure of the refrigerant discharged from the compressor 2 (cf. b4 in FIG. 6), that is, an intermediate pressure (cf. b3 in FIG. 6). That is, the injection refrigerant may be injected into an intermediate stage of the compressor 2. For reference, when the injection refrigerant is injected into a suction stage of the compressor, a low pressure of the heat pump may be increased, thereby degrading an evaporator-side heat exchange capability.

The enthalpy of the refrigerant injected into the compressor 2 in the second injection operation mode (cf. b6 in FIG. 6) may be lower than the enthalpy of the refrigerant injected into the compressor 2 in the first injection operation mode (cf. b6' in FIG. 6).

Accordingly, the refrigerant injected into the compressor 2 in the second injection operation mode may further suppress an excessive increase in pressure and temperature of the refrigerant discharged from the compressor 2. In other words, the second injection operation mode may inject, into the compressor 2, a smaller amount of refrigerant than that of the first injection operation mode and, as such, may decrease the pressure and temperature of the refrigerant discharged from the compressor 2. Such a reduction in injection refrigerant amount may result in a decrease in load and current value of the motor of the compressor 2. As a result, it may be possible to increase an operation frequency (Hz) of the compressor 2 and, as such, to enhance heating performance.

Meanwhile, the remaining refrigerant passing through the flow path of the fourth refrigerant pipe P4, except for the injection refrigerant, that is, the main refrigerant, may be introduced into the compressor 2 while sequentially passing through the second expansion valve E2, the outdoor heat exchanger 5, the selector valve 3, and the accumulator 6.

Referring to FIG. 7, the controller may selectively perform the above-described first injection operation or the above-described second injection operation.

The controller may determine, in the above-described hot water supply operation mode of the heat pump, whether a discharge water temperature is equal to or above a first reference temperature (S1). The discharge water temperature may be a target temperature of water emerging from the water-refrigerant heat exchanger 4. A temperature sensor (not shown) may be installed at the second water pipe Q2, may measure a temperature of the water emerging from the water-refrigerant heat exchanger 4, and may provide information as to the temperature of the water to the controller. For example, the first reference temperature may be 65° C.

Upon determining that the discharge water temperature is lower than the first reference temperature (S1: No), the controller may perform the first injection operation described with reference to FIGS. 3 and 4 (S20). That is, in the first injection operation, the bypass valve VI may be completely closed, and the injection valve E3 may be opened at a certain opening degree. In addition, in the first injection operation, the first expansion valve E1 may be completely opened, and the second expansion valve E2 may be opened at a certain opening degree. Meanwhile, in accordance with an embodiment, in step S20, the opening degree of the injection valve E3 may be increased as the outdoor temperature is lowered. In this case, under the condition that the outdoor temperature is low, it may be possible to enhance heating performance by increasing an amount of refrigerant circulating the heat pump.

Upon determining that the discharge water temperature is equal to or above the first reference temperature (S1: Yes), the controller may perform the second injection operation described with reference to FIGS. 5 and 6 (S11). That is, in the second injection operation, the bypass valve VI may be completely opened, and the injection valve E3 may be opened at a certain opening degree. In addition, in the second injection operation, the first expansion valve E1 may be completely closed, and the second expansion valve E2 may be opened at a certain opening degree.

After step S11, the controller may determine whether the discharge water temperature is equal to or above a second reference temperature (S12). The second reference temperature is higher than the first reference temperature. For example, the second reference temperature may be 70° C.

Upon determining that the discharge water temperature is lower than the second reference temperature (S12: No), the controller may return to step S1.

Upon determining that the discharge water temperature is equal to or above the second reference temperature (S12: Yes), the controller may increase the opening degree of the injection valve E3 (S13). Meanwhile, in accordance with an embodiment, in step S11 or step S13, the opening degree of the injection valve E3 may be increased as the outdoor temperature is lowered. In this case, under the condition that the outdoor temperature is low, it may be possible to enhance heating performance by increasing an amount of refrigerant circulating the heat pump.

Referring to FIG. 8, the above-described first injection operation is represented by FGI, and the above-described second injection operation is represented by LI.

Referring to (a) of FIG. 8, when the outdoor temperature is 7° C., and the discharge water temperature is 65° C., it may be seen that there is no considerable difference of heating capacity (KW) between the first injection operation FGI and the second injection operation LI, but current A flowing through the compressor 2 in the second injection operation LI is decreased by 8%, as compared to that of the first injection operation FGI.

Referring to (b) of FIG. 8, when the outdoor temperature is 7° C., and the discharge water temperature is 70° C., it may be seen that the heating capacity (KW) of the second injection operation LI may be enhanced by 25%, as compared to that of the first injection operation FGI, and the current A flowing through the compressor 2 in the second injection operation LI is decreased by 9%, as compared to that of the first injection operation FGI.

Referring to (c) of FIG. 8, when the outdoor temperature is −15° C., and the discharge water temperature is 70° C., it may be seen that the heating capacity (KW) of the second injection operation LI may be enhanced by 17%, as compared to that of the first injection operation FGI, and the current A flowing through the compressor 2 in the second injection operation LI is decreased by 7%, as compared to that of the first injection operation FGI.

That is, when the discharge water temperature is 65° C. or more, execution of the second injection operation LI may be advantageous in terms of heating capacity (KW) and load of the compressor 2. In addition, the load of the heat pump equipped with the water-refrigerant heat exchanger 4 may be influenced more by the discharge water temperature than by the outdoor temperature.

Referring to FIGS. 1 to 8, a heat pump may include: a compressor configured to compress refrigerant received from an accumulator; a water-refrigerant heat exchanger configured to perform heat exchange of the refrigerant discharged from the compressor with water; a main expansion valve configured to expand the refrigerant emerging from the water-refrigerant heat exchanger; an outdoor heat exchanger configured to perform heat exchange of the refrigerant emerging from the main expansion valve with outdoor air and connected to the accumulator; a main pipe configured to connect the water-refrigerant heat exchanger and the outdoor heat exchanger, the main expansion valve being installed at the main pipe; an internal heat exchanger installed at the main pipe between the water-refrigerant heat exchanger and the main expansion valve; an injection pipe which has one end connected to a first point of the main pipe between the internal heat exchanger and the main expansion valve, which has the other end connected to the compressor, and at which the internal heat exchanger is installed; an injection valve installed at the injection pipe between the first point and the internal heat exchanger; a bypass pipe which has one end connected to a second point of the main pipe between the water-refrigerant heat exchanger and the internal heat exchanger, which has the other end connected to a third point of the main pipe between the internal heat exchanger and the first point; and a bypass valve installed at the bypass pipe.

The main pipe may include a first heat exchange pipe disposed in an interior of the internal heat exchanger, and the injection pipe may include a second heat exchange pipe disposed in the interior of the internal heat exchanger and adjacent to the first heat exchange pipe.

The other end of the injection pipe may be connected to an intermediate stage of the compressor, and the compressor may be an inverter compressor.

Main expansion valve and the injection valve may be an electronic expansion valve (EEV), and the bypass valve may be a solenoid valve.

The heat pump may further include a controller configured to adjust operations of the main expansion valve, the injection valve, and the bypass valve.

Upon receiving a hot water supply operation signal, the controller may completely close the bypass valve and the injection valve, and may open the main expansion valve at a certain opening degree.

When the controller receives the hot water supply operation signal, and a certain condition is satisfied, the controller may completely close the bypass valve, may open the injection valve at a certain opening degree, and may open the main expansion valve at a certain opening degree. The certain condition may be satisfied when an outdoor temperature is lower than a certain temperature or when a target temperature of water emerging from the water-refrigerant heat exchanger is equal to or above a certain temperature.

Upon determining that a discharge water temperature, which is the target temperature of the water emerging from the water-refrigerant heat exchanger, is lower than a first reference temperature, the controller may completely close the bypass valve, may open the injection valve at a certain opening degree, and may open the main expansion valve at a certain opening degree.

Upon determining that the discharge water temperature is equal to or above the first reference temperature, the controller may completely open the bypass valve, may open the injection valve at a certain opening degree, and may open the main expansion valve at a certain opening degree.

Upon determining that the discharge water temperature is equal to or above a second reference temperature higher than the first reference temperature, the controller may increase an opening degree of the injection valve.

The first reference temperature may be 65° C., and the second reference temperature may be 70° C.

The opening degree of the injection valve may be increased as an outdoor temperature is lowered.

The heat pump may further include: a water pipe connected to the water-refrigerant heat exchanger; and a pump installed at the water pipe and configured to generate a flow of water passing through the water-refrigerant heat exchanger.

The heat pump may further include: a selector valve configured to selectively guide the refrigerant discharged from the compressor to the water-refrigerant heat exchanger or the outdoor heat exchanger; and a sub-expansion valve installed at the main pipe between the second point and the internal heat exchanger.

Some of the above-described embodiments of the present disclosure and other embodiments are not exclusive from one another or are not distinguished from one another. Some of the above-described embodiments of the present disclosure and other embodiments may be used together with one another or may be combined with one another.

For example, this means that a configuration A described with reference to a particular embodiment and/or a particular figure and a configuration B described with reference to another embodiment and/or another figure may be coupled to each other. That is, this means that, even though there is no direct description of coupling of configurations, the coupling may be possible, except that the coupling has been described as being impossible.

The above detailed description should not be construed as restrictive in all aspects but as illustrative. The scope of the present disclosure should be determined by a reasonable interpretation of the appended claims, and all changes within the equivalent scope of the present disclosure fall in the scope of the present disclosure.

What is claimed is:

1. A heat pump comprises:

a compressor compressing refrigerant received from an accumulator;

a water-refrigerant heat exchanger exchanging heat between the refrigerant discharged from the compressor and water;

a main expansion valve expanding the refrigerant passed through the water-refrigerant heat exchanger;

an outdoor heat exchanger exchanging heat between the refrigerant passed through the main expansion valve and outdoor air and connected to the accumulator;

a main pipe connecting the water-refrigerant heat exchanger and the outdoor heat exchanger, the main pipe at which the main expansion valve is installed;

an internal heat exchanger installed at the main pipe between the water-refrigerant heat exchanger and the main expansion valve;

an injection pipe which has one end connected to a first point of the main pipe between the internal heat exchanger and the main expansion valve, which has the other end connected to the compressor, and at which the internal heat exchanger is installed;

an injection valve installed at the injection pipe between the first point and the internal heat exchanger;

a bypass pipe which has one end connected to a second point of the main pipe between the water-refrigerant heat exchanger and the internal heat exchanger, which has the other end connected to a third point of the main pipe between the internal heat exchanger and the first point; and a bypass valve installed at the bypass pipe.

2. The heat pump according to claim 1, wherein:

the main pipe comprises a first heat exchange pipe disposed inside the internal heat exchanger; and the injection pipe comprises a second heat exchange pipe disposed inside the internal heat exchanger and adjacent to the first heat exchange pipe.

3. The heat pump according to claim 1, wherein:

the other end of the injection pipe is connected to an intermediate stage of the compressor; and the compressor is an inverter compressor.

4. The heat pump according to claim 1, wherein:

the main expansion valve and the injection valve is an electronic expansion valve (EEV); and the bypass valve is a solenoid valve.

5. The heat pump according to claim 1, further comprising:

a controller adjusting operations of the main expansion valve, the injection valve, and the bypass valve.

6. The heat pump according to claim 5, wherein, when a hot water supply operation signal is received, the controller completely closes the bypass valve and the injection valve, and opens the main expansion valve at a certain opening degree.

7. The heat pump according to claim 5, wherein:

when a hot water supply operation signal is received, and a certain condition is satisfied, the controller completely closes the bypass valve, opens the injection valve at a certain opening degree, and opens the main expansion valve at a certain opening degree; and the certain condition is satisfied when an outdoor temperature is lower than a certain temperature or when a target temperature of water passed through the water-refrigerant heat exchanger is equal to or above a certain temperature.

8. The heat pump according to claim 5, wherein, when it is determined that a discharge water temperature, which is a target temperature of water passed through the water-refrigerant heat exchanger, is lower than a first reference temperature, the controller completely closes the bypass valve, opens the injection valve at a certain opening degree, and opens the main expansion valve at a certain opening degree.

9. The heat pump according to claim 8, wherein, when it is determined that the discharge water temperature is equal to or above the first reference temperature, the controller completely opens the bypass valve, opens the injection valve at a certain opening degree, and opens the main expansion valve at a certain opening degree.

10. The heat pump according to claim 9, wherein, when it is determined that the discharge water temperature is equal to or above a second reference temperature higher than the first reference temperature, the controller increases an opening degree of the injection valve.

11. The heat pump according to claim 10, wherein:

the first reference temperature is 65° C.; and the second reference temperature is 70° C.

12. The heat pump according to claim 10, wherein the opening degree of the injection valve is increased as an outdoor temperature is lowered.

13. The heat pump according to claim 1, further comprises:

a water pipe connected to the water-refrigerant heat exchanger; and a pump installed at the water pipe and causing a flow of water passing through the water-refrigerant heat exchanger.

14. The heat pump according to claim 1, further comprising:

a selector valve selectively guiding the refrigerant discharged from the compressor to the water-refrigerant heat exchanger or the outdoor heat exchanger; and a sub-expansion valve installed at the main pipe between the second point and the internal heat exchanger.

* * * * *